US009897379B2

(12) United States Patent
Thillen et al.

(10) Patent No.: US 9,897,379 B2
(45) Date of Patent: Feb. 20, 2018

(54) SHAFT FURNACE CHARGING DEVICE EQUIPPED WITH A COOLING SYSTEM AND ANNULAR SWIVEL JOINT THEREFORE

(71) Applicant: PAUL WURTH S.A., Luxembourg (LU)

(72) Inventors: Guy Thillen, Diekirch (LU); Jean-Joseph Stumper, Luxembourg (LU); Lionel Hausemer, Sandweiler (LU); Claude Thinnes, Kehlen (LU)

(73) Assignee: PAUL WURTH S.A., Luxembourg (LU)

( * ) Notice: Subject to any disclaimer, the term of this patent is extended or adjusted under 35 U.S.C. 154(b) by 180 days.

(21) Appl. No.: 14/814,212

(22) Filed: Jul. 30, 2015

(65) Prior Publication Data

US 2015/0338166 A1 Nov. 26, 2015

Related U.S. Application Data

(62) Division of application No. 13/389,483, filed as application No. PCT/EP2010/062494 on Aug. 26, 2010, now Pat. No. 9,146,057.

(30) Foreign Application Priority Data

Aug. 26, 2009 (LU) ..... 91601

(51) Int. Cl.
*F27B 1/20* (2006.01)
*F27D 3/00* (2006.01)
(Continued)

(52) U.S. Cl.
CPC ..... *F27B 1/20* (2013.01); *C21B 7/14* (2013.01); *C21B 7/20* (2013.01); *F27B 1/10* (2013.01); *F27B 1/24* (2013.01); *F27D 3/0025* (2013.01)

(58) Field of Classification Search
CPC ..... C21B 7/14; C21B 7/20; F27B 1/10; F27B 1/20; F27B 1/24; F27D 3/0025
(Continued)

(56) References Cited

U.S. PATENT DOCUMENTS 4,273,492 A 6/1981 Legille
4,526,536 A * 7/1985 Legille ..... C21B 7/20 414/206
(Continued)

FOREIGN PATENT DOCUMENTS

DE 3342572 A1 6/1984
EP 1801241 A1 6/2007
(Continued)

OTHER PUBLICATIONS

International Preliminary Report on Patenability dated Feb. 28, 2012 re: Application No. PCT/EP2010/062494.
(Continued)

*Primary Examiner* — Scott Kastler
*Assistant Examiner* — Michael Aboagye
(74) *Attorney, Agent, or Firm* — Cantor Colburn LLP

(57) ABSTRACT

A shaft furnace charging device and cooling system includes a suspension rotor with a charge distributor and stationary housing. The cooling system includes an annular swivel joint arranged coaxially on an axis, connecting stationary and rotary circuit portions. The swivel joint includes forward connections for receiving cooling fluid from the stationary circuit portion and supplying cooling fluid to the rotary circuit portion; return connections for receiving cooling fluid from the rotary circuit portion; and returning cooling fluid to the stationary circuit portion. The swivel joint includes a partition dividing the annular volume into cavities wherein an internal cavity is partially surrounded by an external cavity, and the forward connections are coupled via one of the cavities and the return connections are coupled via the other of the cavities. The swivel joint includes leakage-permitting communication between the external and internal cavities through annular clearances. Annular flow restrictors are provided in clearances.

13 Claims, 10 Drawing Sheets

(51) Int. Cl.

| | |
|---|---|
| ***C21B 7/14*** | (2006.01) |
| ***F27B 1/24*** | (2006.01) |
| ***C21B 7/20*** | (2006.01) |
| ***F27B 1/10*** | (2006.01) |

(58) Field of Classification Search
USPC ..... 266/46, 241, 199, 274, 197, 184, 195; 432/95, 96; 414/203–207
See application file for complete search history.

(56) References Cited

U.S. PATENT DOCUMENTS

| | | | | |
|---|---|---|---|---|
| 6,481,946 | B1 | 11/2002 | Lonardi | |
| 6,544,468 | B1 | 4/2003 | Londardi | |
| 6,857,872 | B2 * | 2/2005 | Lonardi | C21B 7/20 266/197 |
| 8,021,603 | B2 * | 9/2011 | Thillen | C21B 7/20 266/241 |
| 2004/0224275 | A1 | 11/2004 | Lonardi et al. | |

FOREIGN PATENT DOCUMENTS

| | | | |
|---|---|---|---|
| EP | 1935993 | A1 | 6/2008 |
| JP | 55021577 | A | 2/1980 |
| WO | 9928510 | A1 | 6/1999 |
| WO | 03002770 | A1 | 1/2003 |
| WO | 2007071469 | A1 | 6/2007 |

OTHER PUBLICATIONS

International Search Report dated Nov. 18, 2010 re: Application No. PCT/EP2010/062494.
Written Opinion dated Nov. 18, 2010 re: Application No. PCT/EP2010/062494.

* cited by examiner

SHAFT FURNACE CHARGING DEVICE EQUIPPED WITH A COOLING SYSTEM AND ANNULAR SWIVEL JOINT THEREFORE

CROSS REFERENCE TO RELATED APPLICATIONS

This application is a divisional of U.S. patent application Ser. No. 13/389,483 filed on 9 Feb. 2012 which is the U.S. National Phase of International Application Number PCT/EP2010/062494 filed on 26 Aug. 2010 which claims priority to Luxembourg Patent Application Number 91601 filed on 26 Aug. 2009, all of which said applications are herein incorporated by reference in their entirety.

TECHNICAL FIELD

The present invention generally relates to a rotary charging device for charging a metallurgical reactor, in particular a shaft furnace, such as a metallurgical blast furnace. Such a charging device usually comprises a suspension rotor with a charge distributor, typically a pivotable distribution chute, and a stationary housing supporting the suspension rotor so that the rotor—and therewith the distributor—can rotate about an axis, which is typically the furnace central axis. The present invention relates more particularly to a cooling system configured to warrant cooling on the suspension rotor using an annular swivel joint for coupling a stationary portion of the cooling system to a rotary portion that is arranged on the suspension rotor. The invention also relates to the proposed annular swivel joint itself (per se).

BRIEF DISCUSSION OF RELATED ART

It is well known in the art that cooling the suspension rotor, which is exposed to high internal furnace temperatures, by means of liquid coolant is most effective in extending the service life of mechanical components, has a lower initial investment cost and is less energy-consuming, when compared to pure inert gas cooling as suggested e.g. in Japanese patent application JP 55 021 577.

Therefore, as early as 1978, PAUL WURTH proposed water cooling of the charging device of a BELL LESS TOP® installation, as described in detail in U.S. Pat. No. 4,273,492 (see FIG. 8 of this patent). In this device, a lower screen, which protects against radiant heat from inside the furnace, has an associated cooling circuit, which is supplied with liquid coolant via an annular swivel joint arranged coaxially around the central feed channel above the distribution chute. This joint comprises a rotating and a fixed part, which are generally annular i.e. ring-shaped. The rotary part is an extension of the suspension rotor and forms an integral part thereof that extends above the housing. The fixed part is fastened to the housing with a clearance coaxially around the rotary part. Two cylindrical roller bearings centre the rotary part in the fixed part. The fixed part comprises two annular grooves, one above the other, which face ports in the external cylindrical surface of the rotary part to define connection passages for coolant. Watertight seal packings or gaskets have to be mounted to both sides of each groove in between the fixed and rotary parts. In practice a revolving fluid joint of this kind has not proven successful. Indeed, the watertight seals as suggested in U.S. Pat. No. 4,273,492 deteriorate rapidly, among others because they are in contact with a very hot moving part. Moreover, due to the relatively large diameter of the revolving joint and consequently of the watertight seals, considerable friction is inevitable. This limits the service-life of the seals and, besides, also increases required driving power for driving the rotor. Accordingly, a rotating joint of the type described in U.S. Pat. No. 4,273,492 has not proven practically viable for feeding a cooling circuit portion on the suspension rotor.

Therefore, in 1982, PAUL WURTH proposed a cooling system with a revolving joint that works without any watertight seal packings or gaskets. This cooling system, as described in U.S. Pat. No. 4,526,536, now equips numerous blast furnace charging devices throughout the world. It includes an upper annular trough, i.e. a narrow upwardly open receptacle, which is mounted on an upper sleeve of the suspension rotor to rotate therewith. The stationary circuit portion has one or more ports above the upper trough for feeding the latter by gravity. The upper trough is connected to a number of cooling coils installed on the suspension rotor. These coils have outlet pipes discharging into a lower annular fixed trough that is mounted on the bottom of the housing. Cooling water therefore flows from a non-rotating supply into the rotary upper trough of the suspension rotor, then passes purely by gravity trough the cooling coils on the rotor, and from there into the fixed lower trough from where it is discharged. Whilst having the major benefit of avoiding wear-prone watertight seals, a first disadvantage of this cooling system is that pressure available to force cooling water through the cooling coils on the suspension rotor is limited by the difference in height between the upper and lower troughs, which height in turn is inherently limited by constructional constraints. The suspension rotor must therefore be fitted with low-loss cooling coils, which is a considerable disadvantage in terms of cost, occupied space and/or cooling efficiency. A second disadvantage is that dust-laden gases from the blast furnace come into contact with the cooling water in both troughs so that dust inevitably passes into the cooling water. A particular problem is caused by the resulting sludge formed in the upper trough, because the latter passes through the cooling coils of the suspension rotor and may cause blocking i.e. plugging of the coils.

To achieve higher cooling capacity, German patent application DE 33 42 572 proposes to fit the rotary circuit portions on the rotor with an auxiliary pump. This auxiliary pump on the suspension rotor is driven by a mechanism which takes advantage of the rotation of the rotor to drive the pump. It follows that the pump only works when the rotor is rotating. Moreover, such a pump is rather sensitive to sludge passing through the cooling coils on the rotor.

International patent application WO 99/28510 by PAUL WURTH presents a method for operating a cooling system fitted with an annular swivel joint. Contrary to previous principles, no attempt is made to ensure that the joint is watertight, as proposed by U.S. Pat. No. 4,273,492 for example, nor to avoid coolant loss from the joint by means of level controls, as specified in U.S. Pat. No. 4,526,536. Instead, a supply of liquid coolant is provided to the annular swivel joint in such a way that a leakage flow passes through annular separation apertures between the rotating and fixed parts of the joint. This leakage flow forms a "liquid seal", which prevents dust penetrating into the joint. The leakage flow is then collected and drained, without passing through the rotary portion of the circuit. Accordingly, dust-laden sludge no longer passes through the rotary circuit portion so that the risk of clogging is eliminated. WO 99/28510 proposes a number of embodiments for putting into practice the suggested method. Each embodiment comprises an annular fixed part mounted on the stationary housing and an annular rotary part mounted on the suspension rotor. The parts have mating configurations that allow relative rotation. The rotary part, similar to the teaching of U.S. Pat. No. 4,526,536, includes an annular trough that defines an annular volume, via which the stationary and rotary circuit portions are in fluidal communication. The leakage flow passes through annular separation apertures between sidewalls of the trough and sidewalls of an insert that protrudes into the trough and belongs to the fixed part. A first drawback of this system is the loss of cooling water through the "liquid seal", which requires constant topping-up. Furthermore, the system and method proposed in WO 99/28510 still comes with a lower collecting trough (see FIG. 1 of WO 99/28510), similar to that proposed in U.S. Pat. No. 4,526,536, and thus involves additional dust contamination at this level. The lost water fraction and the fraction recovered from the lower trough thus both require treatment before reuse.

International patent application WO 03/002770 by PAUL WURTH presents a further configuration of an annular swivel joint. This joint partially reverts to the initial principles of 1978 since it does not use open collecting troughs connecting the stationary and rotary circuit portions and thereby prevents dust contamination. It comprises a ring-shaped fixed part mounted to the housing and a ring-shaped rotary part rotating with the suspension rotor. The fixed and rotary parts together form a cylindrical interface in which one or more annular grooves allow transferring pressurized liquid coolant between the fixed and rotating rings. To this effect, watertight seals are provided in between the grooves and between the grooves and the open ends of the interface. The rotary part is supported in floating manner solely on the fixed part by means of roller bearings. Selective mechanical coupling means connect the ring-shaped rotary part with the suspension rotor so as to transmit only rotational torque, while at the same time preventing other forces from being transmitted from the rotor to the rotary ring. Liquid coolant is transferred from the rotary part to the circuit portion on the suspension rotor by means of a deformable flexible connection. In the design of WO 03/002770, as opposed to that of U.S. Pat. No. 4,273,492, the rotary ring is supported by the fixed ring. Therefore, the joint in general, and the watertight seals more specifically, are less subject to problems of excessive friction and hence of short service-life. Whilst having the advantages of allowing pressurized forced circulation through cooling coils on the rotor and of significantly increasing the seal service-live, watertight seals arranged between the fixed and rotary ring-shaped parts are still required. Even though subjected to reduced strain, these seals will unavoidably wear-off so that a costly replacement operation is inevitable.

International patent application WO 2007/071469 by PAUL WURTH proposes another joint design for a cooling system as generally set out above. In the latter design, a heat transfer device includes a stationary part configured to be cooled by a cooling fluid flowing through a stationary cooling circuit and a rotary part configured to be heated by separate cooling fluid circulated in the rotary cooling circuit. The parts are arranged in facing relationship and have there between a heat transfer region for achieving heat transfer through the heat transfer region without mixing of the separate cooling fluids in the rotary and stationary circuits. Accordingly, this revolving coupling is not a true fluidal swivel joint but rather a purely thermal coupling. Whilst a thermal coupling according to WO 2007/071469 eliminates both the need for watertight seals and the risk of dust contamination altogether, one drawback of this coupling is that it requires a certain size of facing surfaces forming the heat transfer region in order to warrant a given thermal coupling capacity. In practice, when compared to fluidal swivel joints, this design thus requires more constructional space in case of high thermal loads, e.g. with large diameter blast furnaces. Moreover, means for forced circulation on the suspension rotor, e.g. a pump as disclosed in DE 33 42 572, are required when using conventional cooling coils on the rotor.

In conclusion, although a variety of approaches are known today, the prior art still leaves room for improving the swivel joint required to couple the fixed portion of the cooling system to the rotating portion.

BRIEF SUMMARY

The invention provides an improved cooling system for a shaft furnace charging device and more specifically, an improved annular swivel joint therefore, which eliminates the need of using fluid tight seals while at the same time enabling a pressurized forced circulation of cooling fluid through the rotary part of the cooling system.

The present invention generally relates to a cooling system in a charging device for a metallurgical reactor such as a shaft furnace, especially a blast furnace. The device comprises, in typical manner, a suspension rotor with a charge distributor, e.g. a pivotable chute, and a stationary housing, which supports the suspension rotor so that the latter is rotatable about an axis.

The cooling system comprises a stationary circuit portion, which remains at rest with the housing and a rotary circuit portion that is arranged on the suspension rotor to rotate with the latter. Furthermore, the cooling system comprises an annular swivel joint, which is arranged coaxially on the rotation axis and connects the stationary circuit portion with the rotary circuit portion. In the present context, the expression "swivel joint" refers to a fluid-communicating connector that permits full rotations between the connected circuit portions. In a manner known per se, e.g. from patent application WO 99/28510, the fluidal/hydraulic swivel joint comprises a fixed part supported by the housing and a rotary part mounted on the suspension rotor. The parts have conjugated configurations that allow relative rotation and either one of them includes an annular trough that defines an annular volume, through which cooling fluid can pass from one circuit portion to the other.

According to the disclosure, the proposed fluidal/hydraulic swivel joint presents the following main features:

- at least four connections, including a pair of a forward and a return connection to the stationary circuit portion, and a pair of a forward and a return connection to the rotary circuit portion;
- a partition structure that divides the volume inside the annular trough into an annular external cavity and an annular internal cavity in such a way that the internal cavity is at least partly surrounded by the external cavity and so that the forward path passes through the internal cavity and the return path passes through the external cavity or vice-versa;
- two flow restrictors, each arranged in one of two clearances, through which the two separate cavities communicate and which are provided between the fixed and rotary parts of the joint to allow relative rotation.

As will be appreciated, the proposed fluidal/hydraulic swivel joint is configured so that cooling fluid can circulate in forced circulation from the stationary circuit portion, through one of the first and the second cavities, to the rotary circuit portion and, through the other of the first and the second cavities, back to the stationary circuit portion.

While providing dual coupling of both the forward and return paths and even as it enables forced circulation, the proposed swivel joint is not based on a side-by-side arrangement to achieve the dual coupling nor does it require liquid-tight seals to enable forced circulation through the rotary circuit portion. In fact, both rotary-stationary interfaces on the forward side and on the return side are configured as open connections devoid of liquid-tight seals. More notably however, by virtue of the partition structure according to the invention, the proposed joint integrates one of both open connections to its counterpart i.e. "inside" the other open connection. Thereby, the circuit is truly "open" to the ambient atmosphere only at one of both connections, i.e. at one specific pressure potential of the circuit. Having a circuit open only at one specific pressure potential, the system can provide forced circulation through any kind of rotary circuit, even high-pressure loss circuits, without the need for any wear-prone liquid-tight seal. All that is required is maintaining a pressure differential between the cavities. To this effect, any suitable kind of flow restrictors can be used, such as non-contact labyrinth seals. As another benefit compared to the widespread design of U.S. Pat. No. 4,526,536 it will be noted that the need for a lower collecting trough is eliminated, where most of the dust contamination of the coolant water occurs in the conventional prior art design. Accordingly, construction of the charging device itself can be simplified and, moreover, hitherto provided filtering devices may become unnecessary. This is achieved because the proposed swivel joint functions as a dual coupling of for both paths, i.e. forward and return, and—by virtue of its configuration—it has much less exposed water surface compared to a conventional design according to U.S. Pat. No. 4,526,536.

The present invention also relates to the annular fluidal/hydraulic annular swivel joint itself (per se), for use as a retrofitting component in existing charging devices or for newly equipping other kinds of metallurgical installations or metallurgical reactors, in which cooling of a rotating part of the installation is required. The proposed swivel joint can be used e.g. in the cooling system of the rabbling arms of a multiple hearth furnace. The swivel joint may, of course, also have any of the preferred features set out below when used independent of a shaft furnace charging device.

In a preferred configuration, each of the first and second flow restrictors is respectively configured as non-contact labyrinth seal. In a simple construction, the partition is a multi-part structure that preferably comprises an annular stationary partition member supported by the stationary housing and an annular rotary partition member supported by the suspension rotor. The internal cavity and the clearances can then defined in between and by the shape of the stationary and rotary partition members. To achieve symmetrical pressure drop through both restrictors, the stationary and rotary partition members are advantageously configured generally mirror-symmetric with respect to a vertical bisecting axis, when seen in vertical cross-section. Similarly, the annular first clearance and the annular second clearance are beneficially generally mirror-symmetric with respect to a vertical axis with the annular first flow restrictor being a non-contact labyrinth seal arranged radially outward and the annular second flow restrictor being a non-contact labyrinth seal arranged radially inward. In order to provide substantially equal pressure drop, the difference in radius between the flow restrictors is preferably taken into account and may be compensated e.g. by a difference in effective flow restrictor length.

In a preferred and relatively simple construction of the swivel joint, the rotary part comprises the annular trough, which is mounted on or partially formed by the suspension rotor coaxially on the axis and is preferably of generally U-shaped cross-section; and the fixed part comprises an annular hood, which is mounted on the stationary housing so as to protrude at least partially into the trough and is preferably of generally inverted U-shaped cross-section. In this construction, the trough and the hood are preferably also configured mirror-symmetric with respect to a vertical bisecting axis.

In a particularly preferred embodiment, the stationary partition comprises a hood-shaped ring assembly, preferably of generally inverted U-shaped cross-section, that is arranged inside the hood of the stationary part and has a radially inner side and a radially outer side. In this embodiment, the rotary partition comprises at least one Teflon ring arranged to protrude into the ring assembly, the Teflon ring having a radially inner face and a radially outer face that cooperate with the radially inner side and the radially outer side of the ring assembly so as to provide the first and second clearance there between respectively and so as to form the first and second flow restrictors in the clearances respectively. Teflon is preferred because of its resistance to heat and wetting and its wear-resistance (self-lubricating). In order to easily achieve a certain effective length of the flow restrictors, the swivel joint preferably comprises a plurality of stacked Teflon rings, each having a cross-section of a truncated wedge shape and/or corrugated inner and outer faces so as to form comparatively long first and second flow restrictors, e.g. of the labyrinth seal type.

When using a hood-and-trough configuration, the hood and the trough preferably each have annular inner and outer sidewalls, the sidewalls of the hood being separated from the sidewalls of the trough by narrow substantially vertical gaps, which communicate freely through the external cavity. This configuration minimizes the exposed water surface while also enabling an inherent venting function with an appropriate forward/return connection scheme. To enhance venting through the substantially vertical gaps, the vertical gaps preferably communicate with the external cavity via transverse apertures provided in the sidewalls of the hood or in between the annular hood and the stationary partition member.

In a simple manner of connecting the pairs of forward and return connections, the stationary partition member comprises an upper plate, at which one of the stationary forward and the stationary return connections is provided, whereas the annular hood comprising a top plate, at which the other of the stationary forward and the stationary return connections is provided. Furthermore, the rotary partition member comprises a lower plate, at which one of the rotary forward and the rotary return connections is provided, the annular trough comprising a bottom plate, at which the other of the rotary forward and the rotary return connections is provided. In this configuration the external cavity preferably has an upper portion located between the upper plate and the top plate and a lower portion located between the lower plate and the bottom plate.

Irrespective of the connecting scheme used, the external cavity preferably substantially surrounds the internal cavity. Accordingly, the external cavity beneficially comprises an upper portion arranged above the internal cavity and a lower portion arranged below the internal cavity, both portions communicating, e.g. through the lateral gaps mentioned hereinabove.

As additional enhancements, the fixed part may comprise a coolant level detection device that is connected to control a replenishing valve in the stationary circuit portion. Similarly, the fixed part preferably comprises a venting device for venting any gas inclusions, e.g. from the external cavity.

BRIEF DESCRIPTION OF THE DRAWINGS

Preferred embodiments of the invention will now be described, by way of example, with reference to the accompanying drawings in which.

Identical reference signs or reference signs with incremented hundreds digits are used to identify similar or identical parts throughout the drawings.

DETAILED DESCRIPTION

Figure 1:
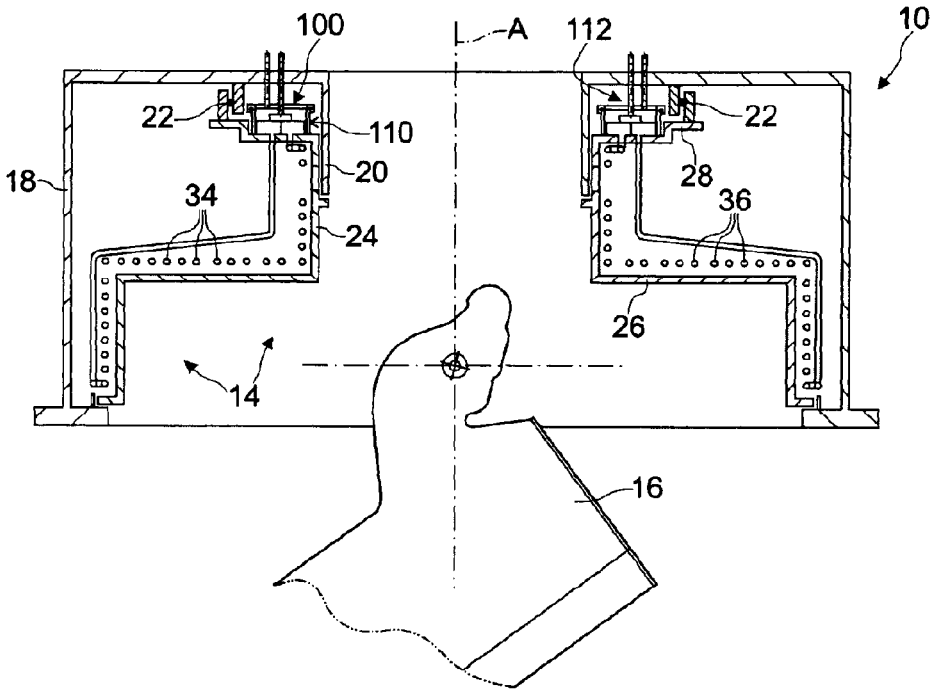
FIG. 1 is a partial vertical cross-sectional view of a charging device equipped with a cooling system and with an annular swivel joint according to a first embodiment.

FIG. 1 partially illustrates a shaft-furnace-charging device, generally identified by reference numeral 10. The charging device 10 is configured for distributing bulk charge material (burden) in targeted manner into a blast furnace. The rotary charging device 10 is equipped with a cooling system 12, illustrated in FIGS. 2-3, for cooling components of the device 10 that are heated by the process temperature inside the furnace. In the charging device 10, a rotatable structure, hereinafter called suspension rotor 14 supports a distribution chute 16. The distribution chute 16 is attached to the suspension rotor 14 by means of a mechanism configured for varying the tilt angle of the chute 16 about a horizontal axis. The rotary charging device 10 further comprises a stationary housing 18 within which the suspension rotor 14 is supported. The stationary housing 18 comprises a fixed tubular central feed channel 20, which is arranged coaxially on the central axis A of the furnace. During the charging procedure, in a manner known per se, bulk material is fed via the feed channel 20, through the stationary housing 18 and the suspension rotor 14, onto the distribution chute 16. The distribution chute 16 distributes charge material radially and circumferentially inside the furnace according to its inclination and rotation.

Except for the cooling system 12, the configuration of the charging device 10 may be of a well-known type. Various well-known components of the charging device 10, such as drive and gear components, are not shown in FIG. 1. These are described in more detail e.g. in U.S. Pat. No. 3,880,302. As seen in FIG. 1, the suspension rotor 14 is supported on the stationary housing 18 by means of an annular bearing 22 so as to be rotatable about axis A. The suspension rotor 14 has an essentially annular configuration with a central passage for bulk material in prolongation of the central feed channel 20. It comprises a cylindrical inner wall portion 24 adjacent the central feed channel 20, a lower flange portion 26 for supporting the chute 16 and protecting the drive and gear components and an upper flange portion 28, which is mounted to the bearing 22. The stationary housing 18 and the suspension rotor 14 constitute the casing of the rotary charging device 10 that typically forms the top closure on the throat of a blast furnace (not shown in FIG. 1).

Figure 2:
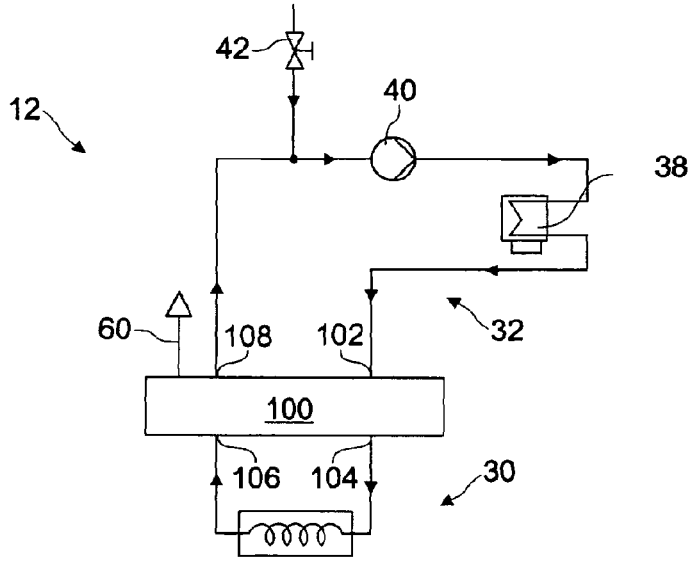
FIG. 2 is a schematic diagram of a simple first variant of a cooling system for use with the device of FIG. 1.
Figure 3:
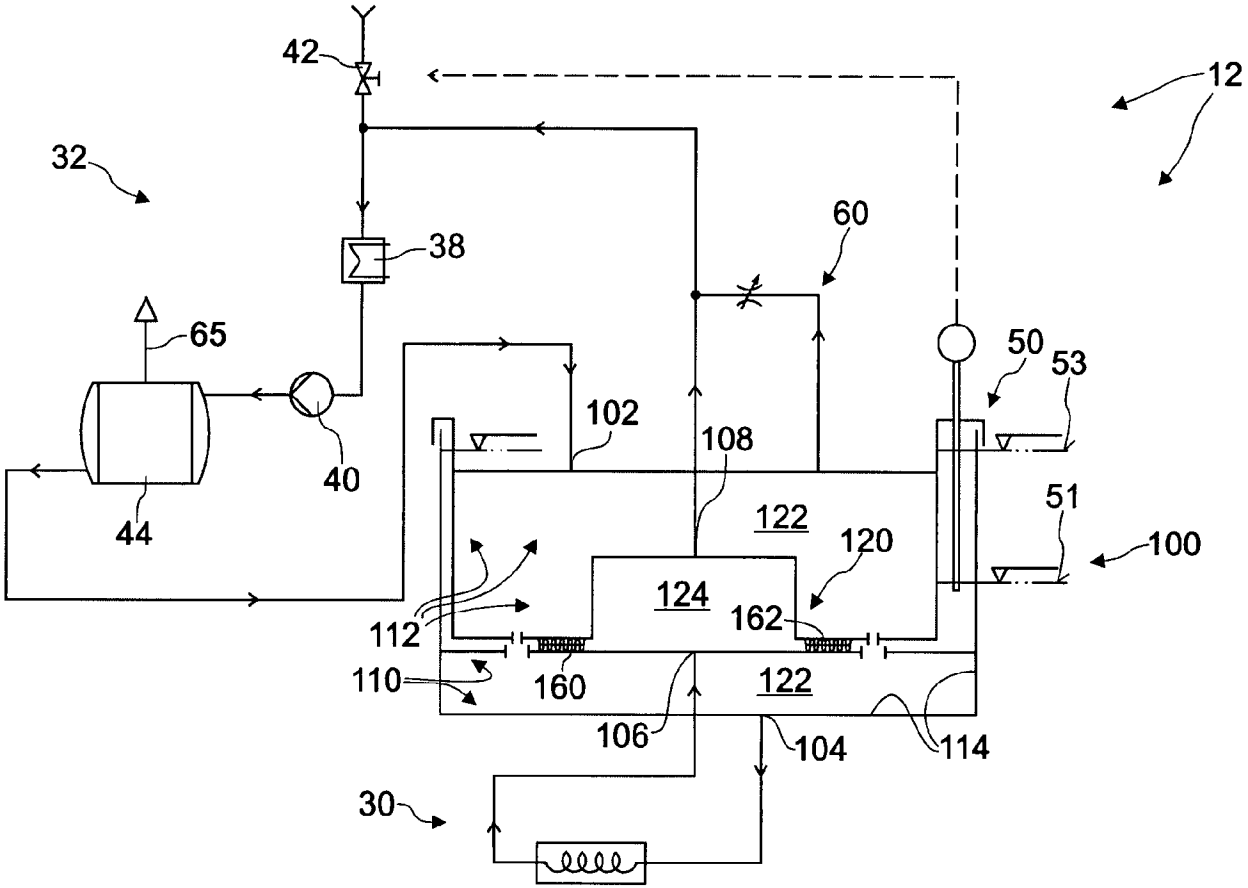
FIG. 3 is a view composed of a schematic diagram of a second variant of a cooling system for use with the device of FIG. 1, including a venting device as shown in FIG. 9, and an enlarged schematic vertical cross-sectional view of the annular swivel joint of FIG. 1.

The cooling system 12 comprises a cooling circuit with a rotary circuit portion 30 fixed on the suspension rotor 14 and a stationary circuit portion 32, which is best seen in FIGS. 2-3, that remains immobile with the stationary housing 18. During operation, the rotary circuit portion 30 rotates with the suspension rotor 14 whereas the stationary circuit portion 32 remains immobile with the housing 18. The rotary circuit portion 30 comprises any suitable heat exchanger, e.g. a heat exchanger comprising several cooling pipe coils, e.g. two coils 34, 36 as shown in FIG. 1, that are arranged on the suspension rotor 14. The coils 34, 36 are in thermal contact with the inner wall portion 24 and the lower flange portion 26, on their inside in order to cool parts of the charging device 10, which are most exposed to the furnace heat. In addition, the rotary circuit portion 30 also provides cooling of the drive and gear components (not shown) provided for rotating and pivoting the chute 16. Although not shown in FIGS. 1-3, the rotary circuit portion 30 may comprise additional cooling pipes/coils, e.g. for cooling the distribution chute 16 itself, as disclosed e.g. in U.S. Pat. No. 5,252,063, or any other suitable kind of heat exchanger configuration.

As will be understood, during operation, the cooling system 12 carries away heat collected by the rotary circuit portion 30 via the stationary circuit portion 32. To this effect, as seen in FIGS. 1-3, the cooling system 12 comprises a heat exchanger 38 and a circulation pump 40, which are part of the stationary circuit portion 32. As further seen in FIGS.

2-3, the stationary circuit portion 32 further comprises a replenishing valve 42 connecting a replenishing conduit, fed e.g. by a public main or local water supply, to the stationary circuit portion 32 for initial filling and for topping up. Liquid coolant, especially water, possibly distilled water, is preferred, although use of other cooling fluids, including gases is possible. In the variant of FIG. 3, the stationary circuit portion 32 further comprises a vent tank 44 for use in combination with the venting device of FIG. 9, which allows for venting the circuits 30, 32.

As will be appreciated, the cooling system 12 is configured to achieve forced circulation of coolant from the stationary circuit portion 32 to the rotary circuit portion 30 and vice-versa, while the latter portion 30 rotates relative to the former portion 32. To this effect, the cooling system 12 includes an annular swivel joint 100, which fluidally couples both circuit portions 30, 32 as schematically seen in FIGS. 1-3. As seen in FIG. 1, the annular swivel joint 100 is provided in an upper portion of the stationary housing 18, e.g. on the upper flange portion 28 and underneath the top plate of the housing 18, other locations being possible. The swivel joint 100 is of generally annular configuration and arranged coaxially on axis A, e.g. so as to surround the feed channel 20 as seen in FIG. 1.

As shown in FIGS. 2-3, the fluidal swivel joint 100 according to the invention comprises a stationary forward connection 102 (stationary inlet), through which it receives coolant from the stationary circuit portion 32, and a rotary forward connection 104 (rotary inlet), through which it supplies coolant to the rotary circuit portion 30. Moreover, the fluidal swivel joint 100 includes a rotary return connection 106 (rotary outlet), through which it receives coolant from the rotary circuit portion 30, and a stationary return connection 108 (rotary outlet), through which it returns coolant to the stationary circuit portion 32. Accordingly, the single fluidal swivel joint 100 serves as dual coupling in both forward (inlet) and return (outlet) directions. As will be understood, the fluidal swivel joint 100 may comprise several pairs of rotary forward and return connections 104, 106, e.g. a pair for each separate coil 34, 36 connected in parallel to the fluidal swivel joint 100. For more equal pressure distribution, the fluidal swivel joint 100 may also comprise several pairs of stationary forward and return connections 102, 108 (see FIGS. 5A-B).

Figure 4:
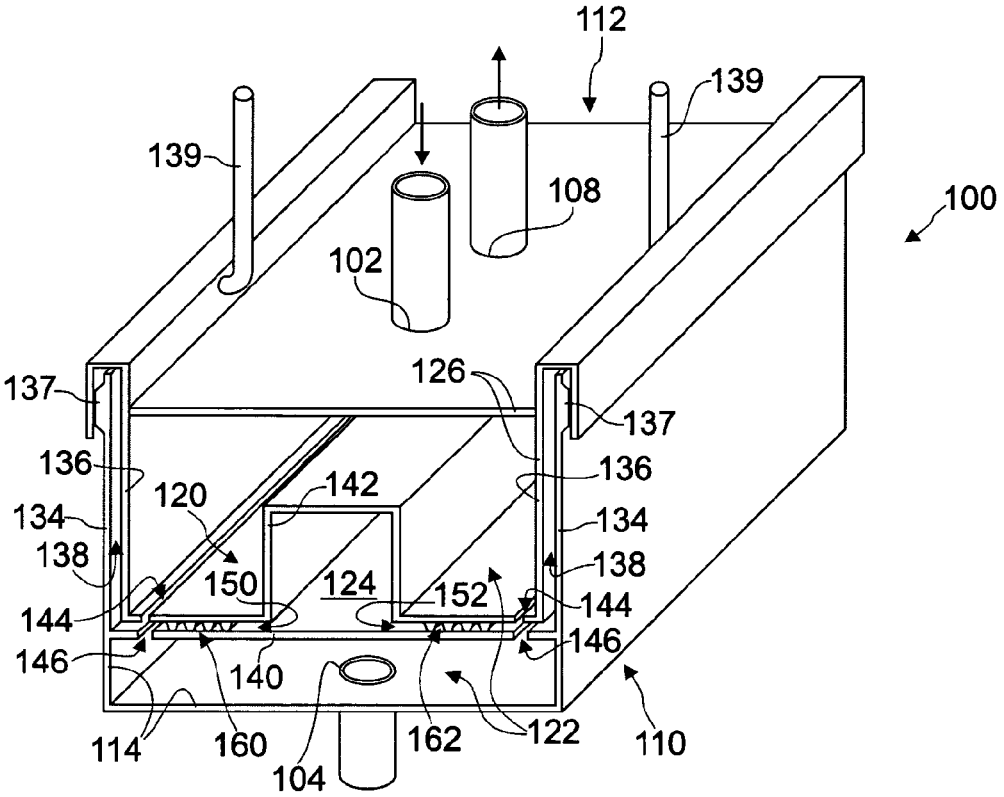
FIG. 4 is a perspective vertical section of the annular swivel joint of FIG. 1.

As seen in FIG. 1 and FIG. 4 (in which annular curvature is not shown), the fluidal swivel joint 100 comprises an annular rotary part 110 that is attached to the suspension rotor 14 and an annular fixed part 112 that is attached to the stationary housing 18. These rotary and fixed parts 110, 112 have conjugated mating configurations that allow fully revolving (>360°) relative rotation. In the embodiment of FIGS. 1-4, the rotary part 110 includes a generally annular trough 114, i.e. a ring-shaped narrow and upwardly open receptacle having the form of a gutter. Although the trough 114 preferably belongs to the rotary part of the joint 100, with parts and connections appropriately inverted, the trough could likewise belong to the fixed part. The trough 114 delimits an annular volume by means of which the circuit portions 30, 32 are in fluidal communication as illustrated in FIG. 3.

As best seen in FIGS. 3-4, a main feature of the fluidal swivel joint 100 is a partition 120 arranged inside the trough 114. More specifically, the partition 120 is a structure that divides the inner volume of the trough 114 into separated regions, namely an annular external cavity 122 and an annular internal cavity 124. In the first embodiment, as best seen in FIG. 3, the partition 120 is configured so that the return connections 106, 108 communicate, i.e. they are fluidally coupled, via the internal cavity 124. Conversely, the forward connections 102, 104 communicate via the external cavity 122. A reversed arrangement of forward and return connections, as described below in relation to FIGS. 5-7 and FIGS. 10-11 is also possible. The partition structure 120 is shaped so that the upper portion of the external cavity 122 partially surrounds the internal cavity 124. With its upper portion taken together with an optional lower portion, the external cavity 122 fully surrounds the internal cavity 124. The lower portion serves as an annular collector for the rotary forward connection(s) 104 and is therefore optional. Similarly, the internal cavity 124 has a certain volume content serving as collector for the stationary return connection 108.

Turning to FIG. 4, purely exemplary constructions of the fluidal swivel joint 100 and of the partition structure 120 will be detailed below. The trough 114 is of generally rectangular U-shaped cross-section and made e.g. of profiled metal sheet sectors, whereas it may also be formed in part by the suspension rotor 14 itself. The fixed part 112, as a main component, comprises an annular hood 126, which is of generally rectangular inverted U-shaped cross-section and also made e.g. of profiled metal sheet sectors. The annular hood 126 is mounted on the stationary housing 18 and protrudes into the trough 114. The rotary trough 114 and the stationary hood 126 each respectively have vertical inner and outer sidewalls 134, 136. The sidewalls 134, 136 are separated by narrow vertical gaps 138, the width of which slightly exceeds the radial tolerance of the bearing 22. The orientation of the gaps 138 may also be slanting, e.g. in V-shape. The upper portion of both sidewalls 136 of the hood 126 is recurved around the upper end of the sidewalls 134 of the trough 114 in order to provide a chicane or labyrinth-like seal that reduces exposure of the gaps 138 to the dust-laden atmosphere from inside the housing 18. To the same effect, the sidewalls 134 of the trough 114 are provided with swellings 137. In order to substantially eliminate exposure to dust, the hood 126 is further provided at the upper recurved end of each sidewall 136 with circumferentially distributed injection pipes 139 connected to an appropriate gas supply. The injection pipes 139 are operated to inject inert gas, e.g. $N_2$, at a pressure that slightly exceeds the pressure inside the housing 18 in order to displace the dust-laden atmosphere out of the gaps 138. The partition 120 on the other hand comprises a ring-shaped rotary partition member 140 and a cooperating ring-shaped stationary partition member 142. The stationary partition member 142 has a cross-section with a Π-shaped (greek "Pi", capital letter) concave central part and horizontal lateral disk flanges on either one side. Furthermore, the annular stationary partition member 142 is provided with interrupted circular arc-shaped apertures 144 arranged circumferentially in each lateral end portion of the horizontal flanges. At its extremities, the partition member 142 is fixed to the lower ends of the sidewalls 136 of the hood 126. The annular partition member 142 can be assembled of correspondingly shaped sectors of punched and profiled sheet metal. The rotary partition member 140 of FIGS. 1-4 is a simple ring-shaped plate having interrupted circular arc-shaped apertures 146 arranged circumferentially in its radially inward and outward end regions so as to face the apertures 144. The rotary partition member 140 is fixed at its extremities to the sidewalls 134 of the trough 114 at a certain height inside the trough 114. As will be understood, each pair of facing apertures 144, 146 warrants unrestrained free communication between the upper and lower portions of the external cavity 122 and thus between the forward connections 102, 104. The partition members 140, 142 are spaced by a vertical distance that slightly exceeds the axial tolerance of the bearing 22.

In order to allow unimpeded relative rotation between the fixed part 112 and the rotary part 110, the joint 100 has an annular first clearance 150 and an annular second clearance 152 provided between the partitioning members 140, 142. Due to this required clearance, the external cavity 122 and the internal cavity 124 are necessarily in leakage permitting communication. As will be appreciated however, the partition 120 is configured to provide a double and substantially symmetrical communication through both clearances 150, 152. To this effect, the stationary and rotary partition members 140, 142 are configured mirror-symmetric, i.e. left-right symmetric, with respect to an imaginary vertical bisecting axis of the joint 100 (see dashed line in FIGS. 6A-D) in general and of the annular trough 114 in particular. Similarly, the trough 114 and the hood 126 are both generally mirror-symmetric. Thereby, despite leakage between the cavities 122, 124, largely spatially uniform, left-right symmetrical pressure conditions exist inside the external cavity 122. As a result, essentially equal water levels are warranted inside the gaps 138, which both communicate freely with each other through the external cavity 122. The crosswise width of the clearances 150, 152 corresponds to the spacing between the partition members 140, 142, i.e. a distance that slightly exceeds the axial tolerance of the bearing 22. As may also be noted, the width of the apertures 146 in the rotary partition member 140 is preferably larger than the crosswise width of the clearances 150, 152, whereas the width of the apertures 144 in the stationary partition member merely needs to warrant free communication between the upper and lower portions of the external cavity 122.

In order to enable forced circulation of coolant through the rotary circuit portion 30, e.g. through the coils 34, 36, by action of the stationary pump 40, short-circuiting of coolant flow through the clearances 150, 152 should be minimized. To this purpose, annular first and second flow restrictors 160, 162 are provided in the first and second clearances 150, 152 respectively. The flow restrictors 160, 162 are configured to minimize leakage between the external and internal cavities 122, 124, i.e. to minimize short-circuiting of the coolant flow through the clearances 150, 152. In other words, since the clearances 150, 152 physically form "parasitic conduits" connected in parallel to the rotary circuit portion 30, the flow restrictors 160, 162 are provided to significantly increase the flow resistance of these undesired parallel "parasitic conduits". Preferred flow restrictors 160, 162 are non-contact labyrinth seals formed e.g. by conjugated protrusions and/or recesses on both or either one of the facing portions of the partition members 140, 142 that form the clearances 150, 152. A major advantage of this type of flow restrictor 160, 162 is that they do not wear off.

Returning to FIG. 3, an arrangement for controlling the coolant level inside the fluidal swivel joint 100 comprises a level sensor 50, schematically illustrated in FIG. 3. The level sensor 50 is arranged in one of the gaps 138 (FIG. 4) and used to detect whether the coolant falls below the minimum level, indicated at 51. When the minimum level 51 is reached, the level sensor 50, e.g. by use of a controller of suitable known configuration (not shown), triggers opening of the motorized replenishing valve 42 for topping up a loss of coolant, typically caused by evaporation. The level sensor 50 also detects reaching of the maximum level, indicated at 53, in order to trigger closing of the replenishing valve 42. The maximum level 53 is set above the top plate of the hood 126 so that, during normal operation, the external cavity 122 is substantially filled with coolant. FIGS. 2-3 further show a venting device 60, which will be described below with reference to FIG. 9.

A second embodiment of an annular swivel joint 200 will now be described by reference to FIGS. 5-7. Main features being identical to those of the previous embodiment, only the differences will be set out below. The plan views of FIG. 5A and FIG. 5B best illustrate the annular configuration (which applies analogously to FIGS. 1-4) of the swivel joint 200.

Figure 5A:
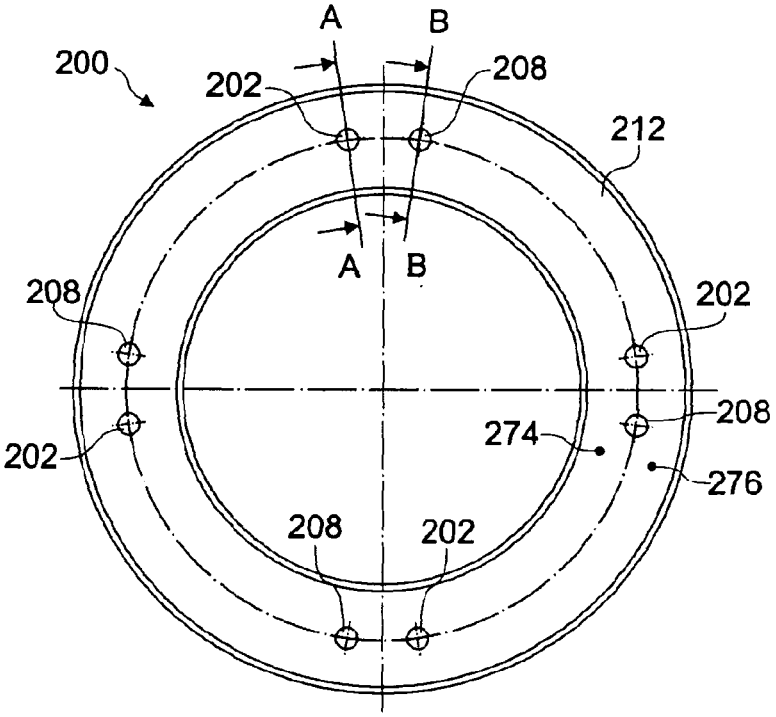
FIG. 5A is a top view of a second embodiment of an annular swivel joint.

As seen in FIG. 5A, illustrating the fixed part 212 in top view, the fluidal swivel joint 200 comprises four stationary forward connections 202 and four stationary return connections 208, which respectively connect forward (supply/flow) and return (runback) manifolds (not shown) of the stationary circuit portion 32 to the joint 200. The stationary connections 202, 208 are arranged equi-circumferentially and centrally in the radial sense for maintaining circumferentially uniform pressure conditions within the generally left-right symmetric joint 200.

Figure 5B:
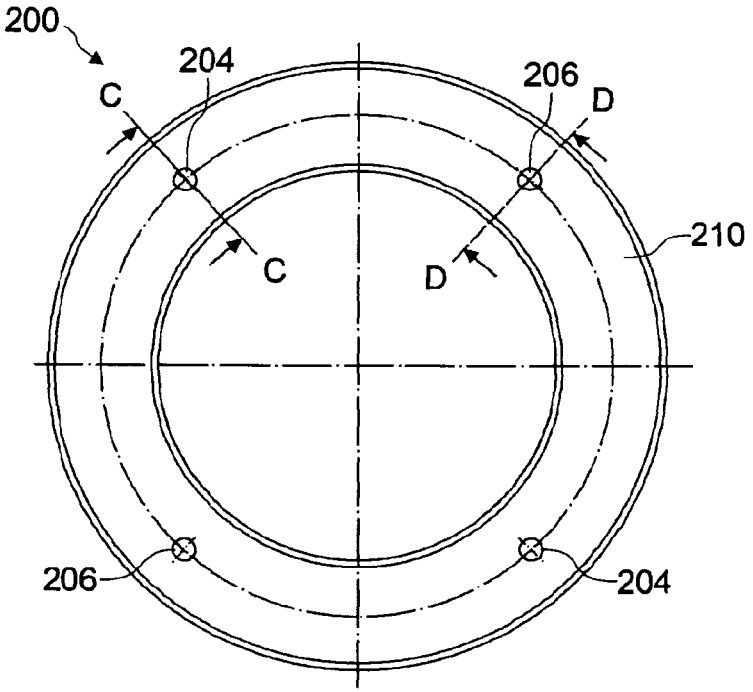
FIG. 5B is a bottom view of a second embodiment of an annular swivel joint.

FIG. 5B illustrates the rotary part 210 in bottom view. As seen in FIG. 5B, the fluidal swivel joint 200 is configured for supplying two parallel parts of the rotary circuit portion 30, e.g. two cooling pipe coils 34, 36 as illustrated in FIG. 1. Accordingly, the joint 200 comprises two pairs of diametrically opposite rotary forward connections 204 and rotary return connections 206.

Figure 6A:
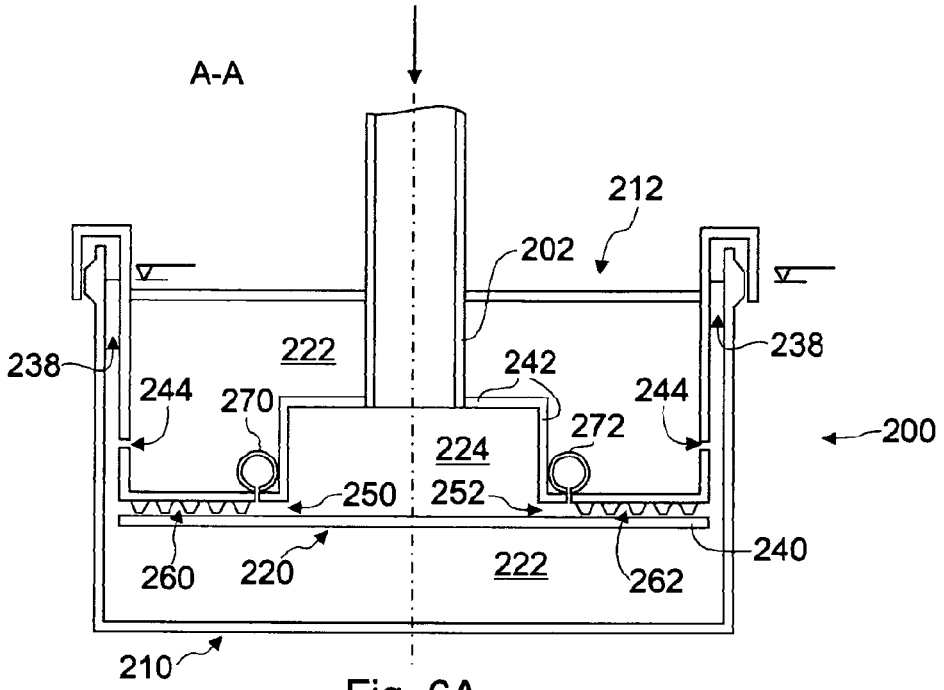
FIG. 6A is a vertical cross-sectional view of the second embodiment of an annular swivel joint according to lines A-A of FIG. 5A.
Figure 6B:
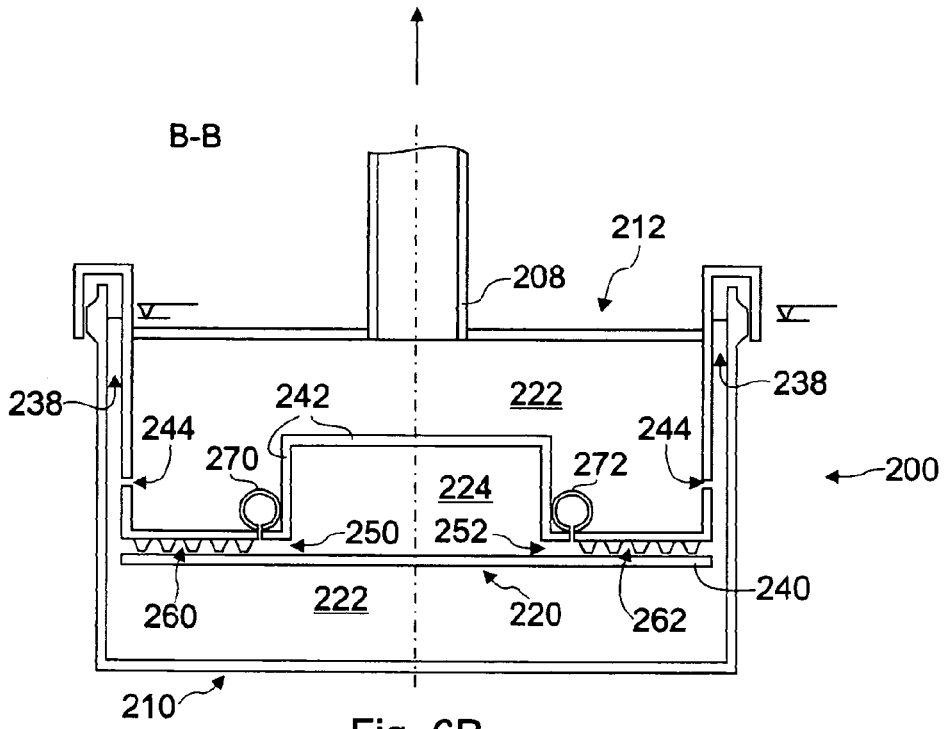
FIG. 6B is a vertical cross-sectional view of the second embodiment of an annular swivel joint according to lines B-B of FIG. 5A.
Figure 6C:
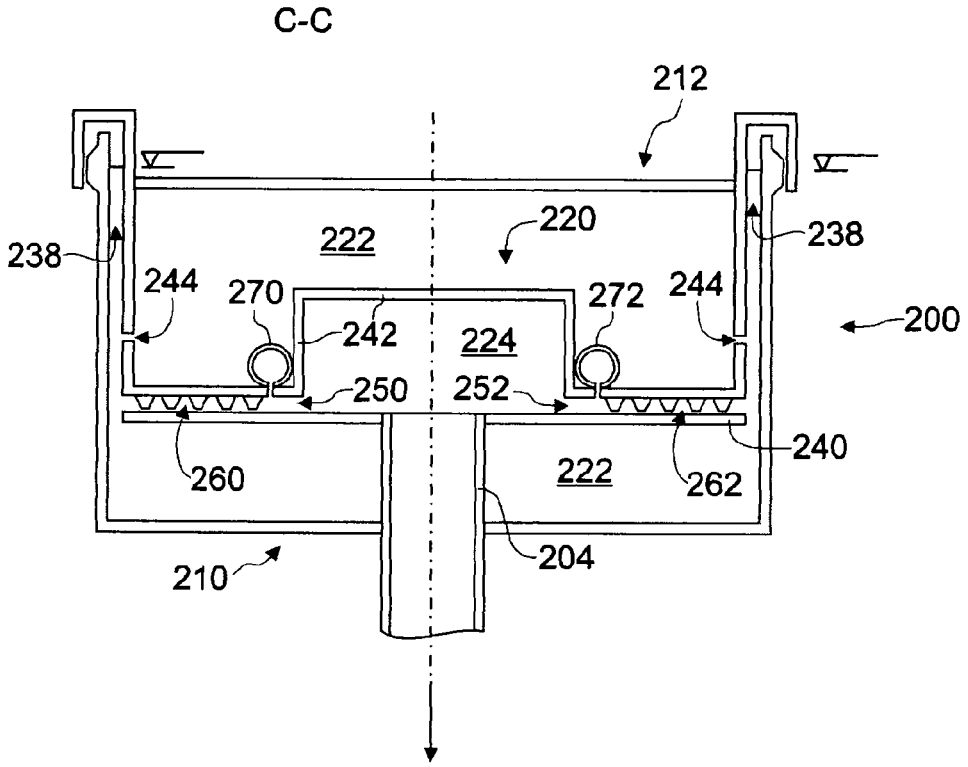
FIG. 6C is a vertical cross-sectional view of the second embodiment of an annular swivel joint according to lines C-C of FIG. 5B.
Figure 6D:
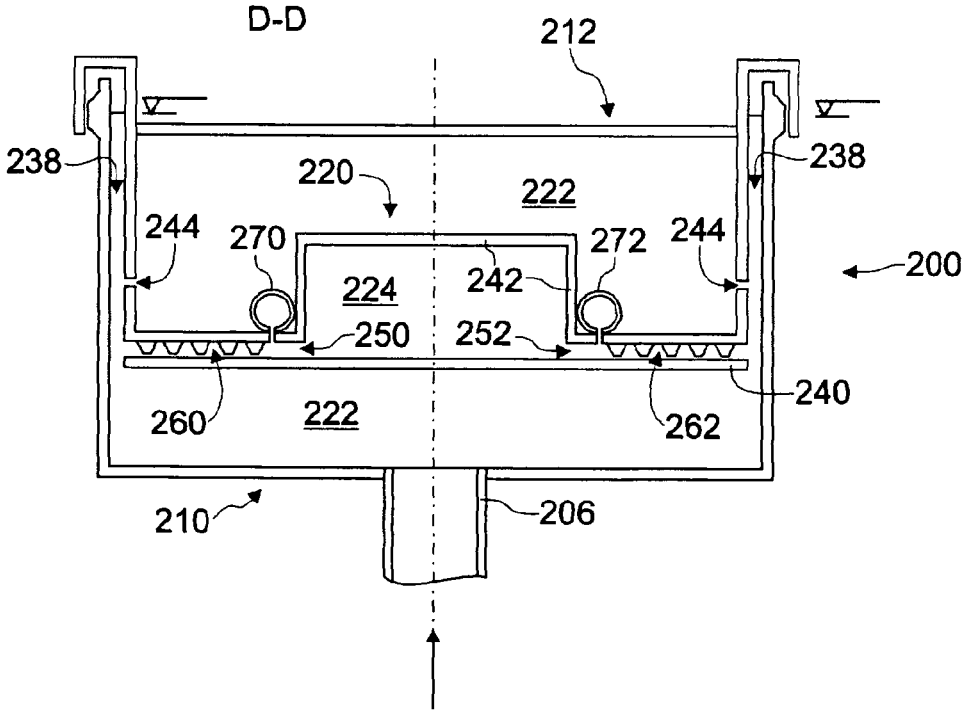
FIG. 6D is a vertical cross-sectional view of the second embodiment of an annular swivel joint according to lines D-D of FIG. 5B.

In FIGS. 6A-6D only main reference signs are provided for alleviation of the drawings. As seen in FIGS. 6A-6D and as opposed to FIGS. 1-4, in the swivel joint 200, the forward connections 202, 204 are coupled through the internal cavity 224, i.e. on the inside of the partition structure 220, whereas the return connections 206, 208 are coupled through the external cavity 222, i.e. on the outside of the partition 220. More specifically: As shown in FIG. 6A, the stationary forward connections 202 debouch into the internal cavity 224 at the upper plate in the H-shaped central portion of the stationary partition member 242. As seen in FIG. 6C, the rotary forward connections 204 spring from the internal cavity 224 at the central part of the rotary partition member 240 that forms a lower plate. On the other hand, concerning the return connections 206, 208, the rotary return connections 206 debouch into the lower portion of the external cavity 222 at the bottom plate of the trough-shaped rotary part 210, whereas the stationary return connections 208 spring from the upper portion of the external cavity 222 at the top plate of the hood-shaped rotary part 212. A configuration according to FIGS. 1-4, in which the forward path passes through the external cavity 122 and the return path passes through the internal cavity 124, maximizes the volume of coolant that may evaporate and thus minimize the frequency of replenishing through replenishing valve 42. The connection scheme and circulation sense of FIGS. 5-7 however enables integrating a simpler self-venting solution into the swivel joint 200, which will be detailed below with respect to FIGS. 10-11.

Figure 7:
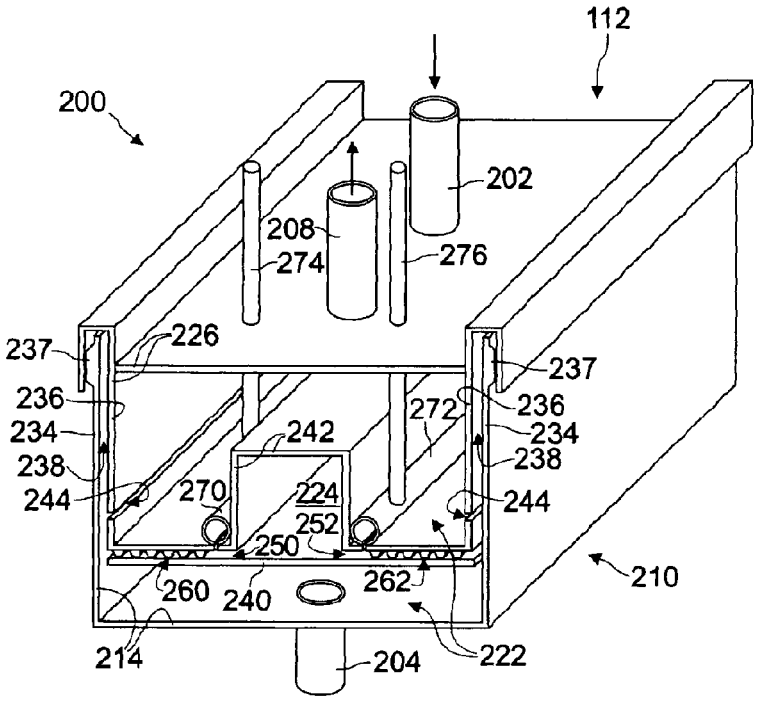
FIG. 7 is a perspective vertical section of the annular swivel joint of FIGS. 6A-C.

As further seen in FIGS. 6A-D and FIG. 7, the fluidal swivel joint 200 comprises first and second annular gas distributor pipes 270, 272 connected to a suitable supply of gas, especially of inert gas such as $N_2$. Each gas distributor pipe 270, 272 is respectively associated to one annular clearance 250, 252. Each gas distributor pipe 270, 272 is provided equi-circumferentially with injector nozzles or simple bores that communicate through a corresponding hole or bore in the stationary partition member 242 with the associated clearance 250, 252 for injecting a bubbling gas, into the liquid coolant on the forward (upstream) side of the clearances 250, 252. With the higher forward coolant pressure in the internal cavity 224, each distributor pipe 270, 272 thus injects gas for bubbling the coolant on the upstream side of the flow restrictors 260, 262. By virtue of the resulting effervescence, the flow resistance created by the labyrinth seal-type flow restrictors 260, 262 is further enhanced. As seen in FIGS. 6A-D, the configuration of the gas distributor pipes 270, 272 is symmetrical in order to equally enhance the effectiveness of both flow restrictors 260, 262. As will further be appreciated, the bubbling gas injection through the distributor pipes 270, 272 also assumes the function of creating a displacement pressure inside the vertical gaps 238 between the fixed part 212 and the rotary part 210 to avoid dust contamination. To this effect, the downstream end of each clearance 250, 252 debouches directly into the corresponding gap 238. In order to avoid inclusion of gas bubbles in the coolant that returns through the external cavity 222, the communication between the upper and lower portions of the external cavity 222 is established through horizontal apertures 244 arranged in the horizontal sidewalls of the hood 226, as best seen in FIG. 7. The horizontal apertures 244 enable general venting of the circuits 30, 32 and venting of inclusions of bubbling gas injected via the distributor pipes 270, 272, since gases tend to rise upwards through the gaps 238, which act as annular uptakes communicating with the ambient atmosphere. Accordingly, the upper and lower portions of the external cavity 222 communicating freely trough the gaps 238 and apertures 244, bubbling gas rises upwards in the gaps 238 and is only minimally included in the return flow from the external cavity 222 to the stationary circuit portion 32.

In the perspective view of FIG. 7, the illustrated fluidal swivel joint 200 is provided with additional reference sings with an incremented hundreds digit compared to FIG. 4, which identify features that are identical or similar to those described above in relation to FIG. 4. FIG. 7 further illustrates respective feed pipes 274, 276 of the gas distributor pipe 270, 272, which feed inert gas for injection into the clearances 250, 252.

Figure 8:
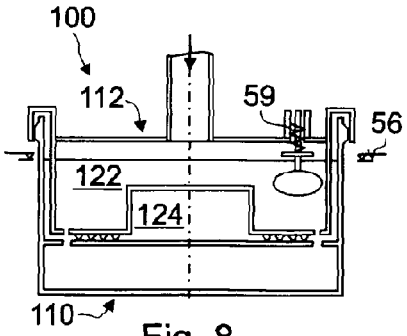
FIG. 8 is vertical cross-sectional view of an annular swivel joint according to FIGS. 1-4 illustrating a first embodiment of a venting device.

FIG. 8 illustrates the fluidal swivel joint 100 of FIGS. 1-4 equipped with a first embodiment of a venting device 59. The venting device 59 is a venting valve of the float valve type and is arranged in the top plate of the hood-shaped fixed part 112 so as to vent the upper portion of the external cavity 122 in case the coolant level drops below a predetermined level, e.g. a venting level 56 as indicated in FIG. 8.

Figure 9:
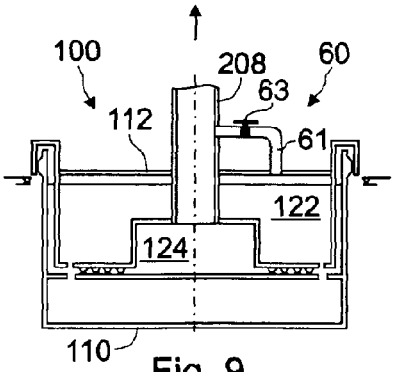
FIG. 9 is vertical cross-sectional view of an annular swivel joint according to FIGS. 1-4 illustrating a second embodiment of a venting device.

FIG. 9 illustrates the fluidal swivel joint 100 of FIGS. 1-4 equipped with a second embodiment of a venting device 60. The venting device 60 is designed in particular for venting residual air and vapour locked in the circuits 30, 32. It comprises a small-diameter venting pipe 61 bridging the uppermost region of the external cavity 122 to the stationary return connection 208 and a ventilating valve 63 provided in the venting pipe 61 for adjusting the venting rate of gas/vapour. The ventilating valve 63 allows only a minimal amount of liquid coolant to pass through the venting pipe 61 into the return connection 208. Due to the draught caused by forced circulation, gases in the external cavity 122 are automatically evacuated through the return connection 208, and may then be de-aerated by means of an auxiliary venting device 65 provided on the vent tank 44 (see FIG. 3), in which residual air and vapour bubbles up.

Figure 10:
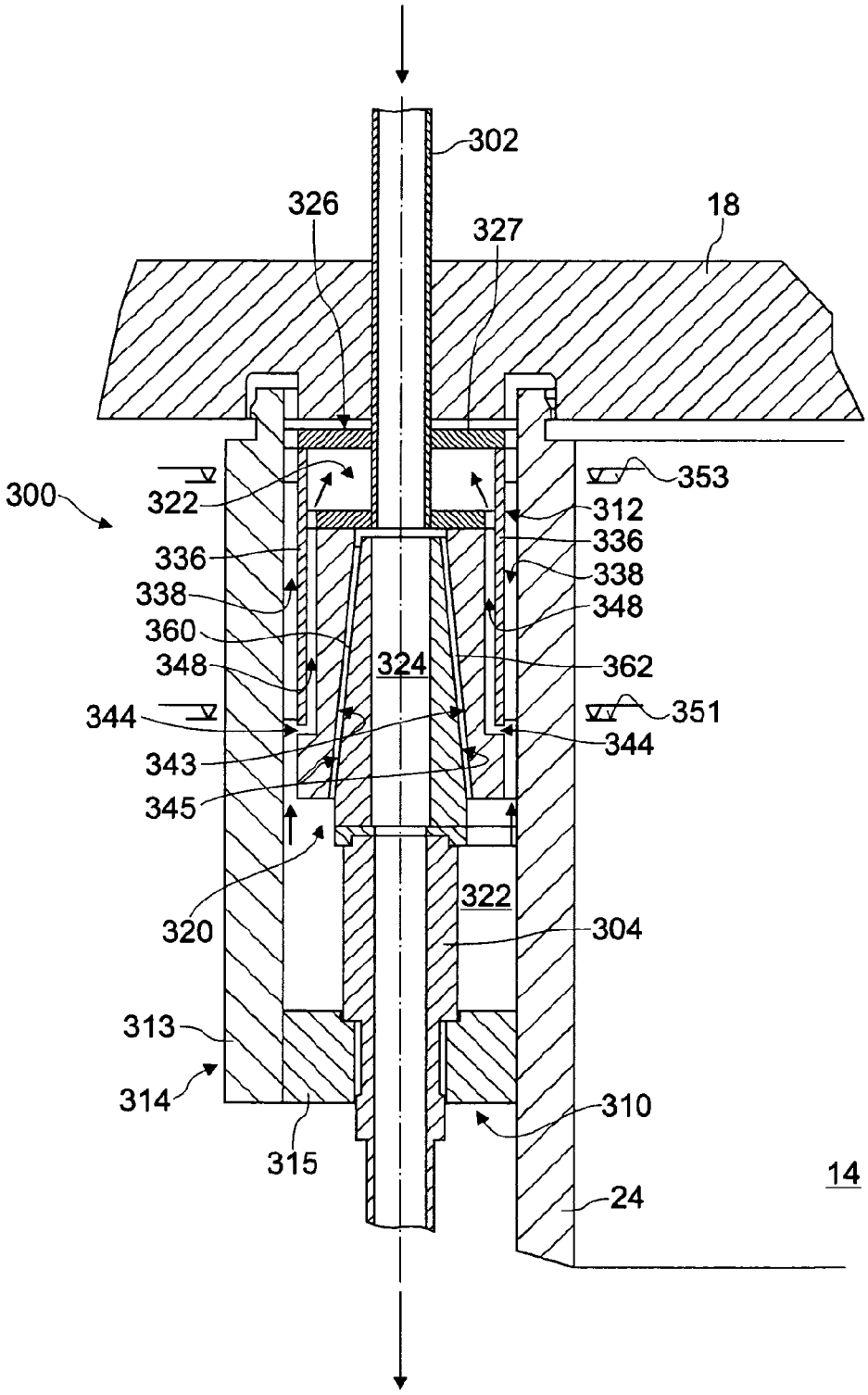
FIG. 10 is a vertical cross-sectional view of an annular swivel joint according to a third embodiment, which corresponds to a view taken along coinciding lines A-A and C-C of FIGS. 5A-B.
Figure 11:
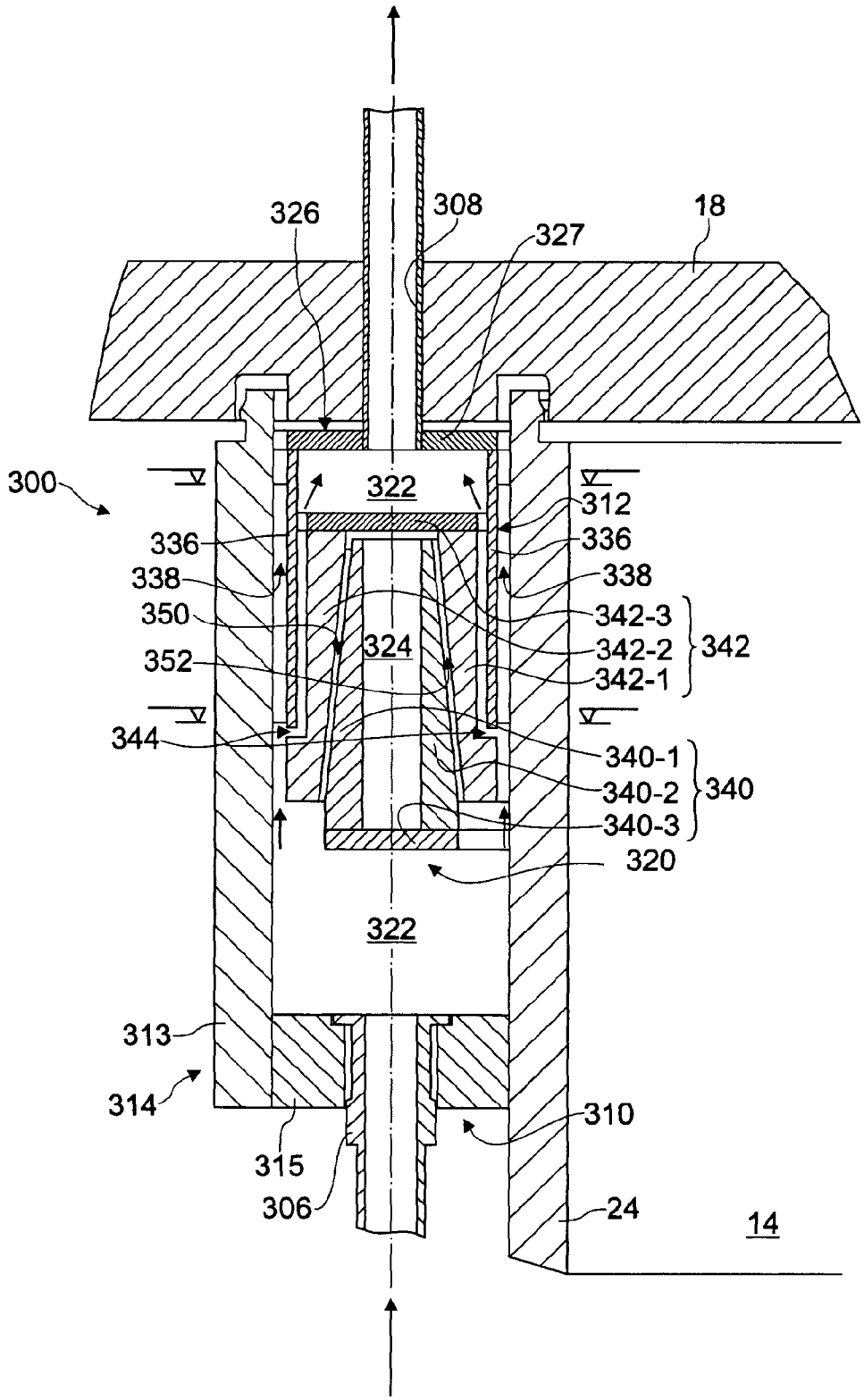
FIG. 11 is a vertical cross-sectional view of an annular swivel joint according to a third embodiment, which corresponds to a view taken along coinciding lines B-B and D-D of FIGS. 5A-B.

Referring now to FIGS. 10-11, a preferred third embodiment of a fluidal swivel joint 300 will be described below.

In the joint 300 of FIGS. 10-11, the rotary part 310 comprises an annular trough 314 of substantially rectangular U-shaped cross-section that is formed, on one side, by the upper part of the cylindrical inner wall portion 24 of the suspension rotor 14, and on the other side, by a cylindrical ring 313 fixed to the wall portion 24 by means of a disc-shaped bottom plate 315. The fixed part 312 comprises an annular hood 326, of inverted substantially rectangular U-shaped cross-section, which protrudes approximately halfway into the annular volume defined by the annular trough 314. The trough 314 and the hood 326 are dimensioned so that narrow vertical gaps 338 between the sidewalls 24, 313 of the trough 314 and the sidewalls 336 of the hood 326 have minimal width required for unimpeded rotation of the trough 314 relative to the hood 326. As seen in FIGS. 10-11, the upper end portions of the sidewalls 24, 313 of the trough 314 protrude into conjugated recesses provided in the top plate of the stationary housing 18 so as to form a chicane or labyrinth-like joint reducing exposure of the gaps 338 to dust.

As best illustrated in FIG. 11, the fluidal swivel joint 300 also comprises a partition structure 320 that divides the inner volume of the trough 314 into an annular external cavity 322 and an annular internal cavity 324. The stationary partition member 342 of the partition 320 mainly comprises two annular downwardly tapering machined parts 342-1, 342-2 fixed to a disc-shaped upper plate 342-3. Similarly, the rotary partition member 340 mainly comprises two annular upwardly tapering machined parts 340-1, 340-2 fixed to a lower disc-shaped plate 340-3. The stationary partition member 342 is fixed to the stationary housing 18, whereas the rotary partition member 340 is fixed to the wall portion 24 of the suspension rotor. As will be appreciated, both partition members 340, 342, as well as the trough 314 and the hood 326 are generally left-right symmetrical in cross-section.

Each stationary machined part 342-1, 342-2 defines a respective oblique inner labyrinth surface 343 facing a respective conjugated oblique outer labyrinth surface 345 defined by either one of the rotary machined parts 340-1, 340-2. The annular surfaces 343, 345 may be simple stepped surfaces, simple corrugated surfaces or surfaces with alternating protrusions and recesses that are arranged to interdigitate, similar to the labyrinth seal disclosed in FIG. 4-5 of WO 99/28510. Between the surfaces 343, 345, the rotary and stationary partition members 340, 342 define annular clearances 350, 352 of minimal width as required to permit rotation. As will be understood, the external and internal cavities 322, 324 communicate through these clearances 350, 352. Accordingly, similar to the previous embodiments, the labyrinth surfaces 343, 345 form flow restrictors 360, 362 in each clearance 350, 352 respectively in order to minimize short-circuiting flow between the cavities 322, 324.

As seen in FIGS. 10-11, the rotary partition member 340 is shaped and arranged to protrude into the stationary partition member 342 with the labyrinth surfaces 343, 345 facing each other so that the clearances 350, 352 form branches of a generally inverted V-shape in cross-section. This oblique arrangement allows increasing the length of the flow restrictors 360, 362 i.e. the non-contact labyrinth seals defined by the surfaces 343, 345, without increasing the overall height/width of the partition 320. As will be appreciated, in the joint 300, the flow restrictors 360, 362 extend substantially over the entire length of the oblique clearances 350, 352, which exceeds the height (greatest sectional dimension) of the internal cavity 324, in order to maximize achieved flow resistance/pressure drop.

As further seen in FIGS. 10-11, the upper and lower portions of the external cavity 322 communicate unrestrictedly through annular vertical channels 348 between the cylindrical outer surfaces of the stationary machined parts 342-1, 342-2 and the sidewalls 336 of the hood 326 and via the lower portions of the vertical gaps 338 into which the channels 348 debouch through transversely, e.g. horizontally, arranged apertures 344. Accordingly, any general gas inclusions, including optionally gas injected by optional gas bubbling upstream of the clearances 350, 352, can be largely prevented from entering the upper portion of the external cavity 322, i.e. from entering the return path through the stationary return connection 308.

Venting works in substantially identical manner as in swivel joint 200 of FIGS. 5-7: Any included gas preferentially passes by the apertures 344 and rises upwardly through the upper portion of the gaps 338 to be vented to the atmosphere, e.g. to the inside of housing 18. Returning coolant, on the other hand, is forced from the lower portion of the external cavity 322, through the lower portion of the gaps 338, to turn laterally through the horizontal apertures 344 into the channels 348 to pass into the upper portion of the external cavity 322. Accordingly, by virtue of the horizontally arranged apertures 344 and the chosen flow sense, i.e. the return flow passing upwardly through the external cavity 322, the swivel joint 300 has an integrated self-venting configuration, venting air/gas through the inherent gaps 338. An advantage of the self-venting solutions of FIGS. 5-7 and FIGS. 10-11, resides in that a vent tank arrangement as in FIG. 3 and venting devices as in FIGS. 8-9 can be omitted so that a simpler cooling circuit 12 as in FIG. 2 can be used. As will be understood, proper venting of residual air and vapour locked in the coolant enables complete filling of the circuit portions 30, 32 and warrants uninterrupted forced circulation through the rotary and stationary circuit portions 30, 32 by action of pump 40.

FIG. 10 also illustrates the minimum and maximum water levels 351, 353, between which coolant is maintained during normal operation by means of an appropriate level detection device that controls replenishing via the replenishing valve 42 (see FIG. 2) to avoid suction of ambient air into the return connection 308 and overflow of coolant out of the gaps 338.

In operation, the fluidal swivel joint 300 works as follows:

As illustrated in FIG. 10, cooled liquid coolant is supplied under pressure by the pump 40 from the stationary circuit portion 32 through the stationary forward connection 302 into the internal cavity 324. To this effect, the stationary forward connection 302 passes trough the upper plate 342-3 of the stationary partition member 342. From the pressurized internal cavity 324, most of the coolant is supplied to the "forward side" of the rotary circuit portion 30, e.g. to a coil 34, 36, through the rotary forward connection 304 (only incidentally located in the same plane as the stationary forward connection 302 in the position shown in FIG. 10). To communicate with the internal cavity 324, the rotary forward connection 304 passes trough the lower plate 340-3 of the rotary partition member 340. Accordingly the rotary circuit portion 30 is provided with pressurized coolant, i.e. subjected to forced circulation through the fluidal swivel joint 300. Short-circuiting coolant flow through the clearances 350, 352 on the other hand is minimized by the facing pairs of surfaces 343, 345 which form a labyrinth seal.

As best illustrated in FIG. 11, heated liquid coolant that has absorbed heat, e.g. at one of several coils 34, 36, is returned from the rotary circuit portion 30 via the rotary return connection 306, which debouches into the lower portion of the external cavity 322 through a central bore in the bottom plate 315. From there, coolant is forced upwardly through a lower region of the gaps 338, laterally into and upwardly through the annular vertical channels 348, into the upper portion of the external cavity 322. From there, liquid coolant passes via the stationary return connection 308, which takes source in the upper portion of the external cavity 322 through a central bore in the disc-shaped top plate 327 of the annular hood 326, back to the return side of the stationary circuit portion 32.

As will be understood, operation of the fluidal swivel joint 200 of FIGS. 5-7 is substantially identical, whereas operation of the fluidal swivel joint 100 of FIGS. 1-4 differs mainly in the inverted forward and return connections 102, 104; 106, 108 and therewith the opposite coolant circulation sense and, moreover in the manner by which the circuits 30, 32 are vented.

Figure 12:
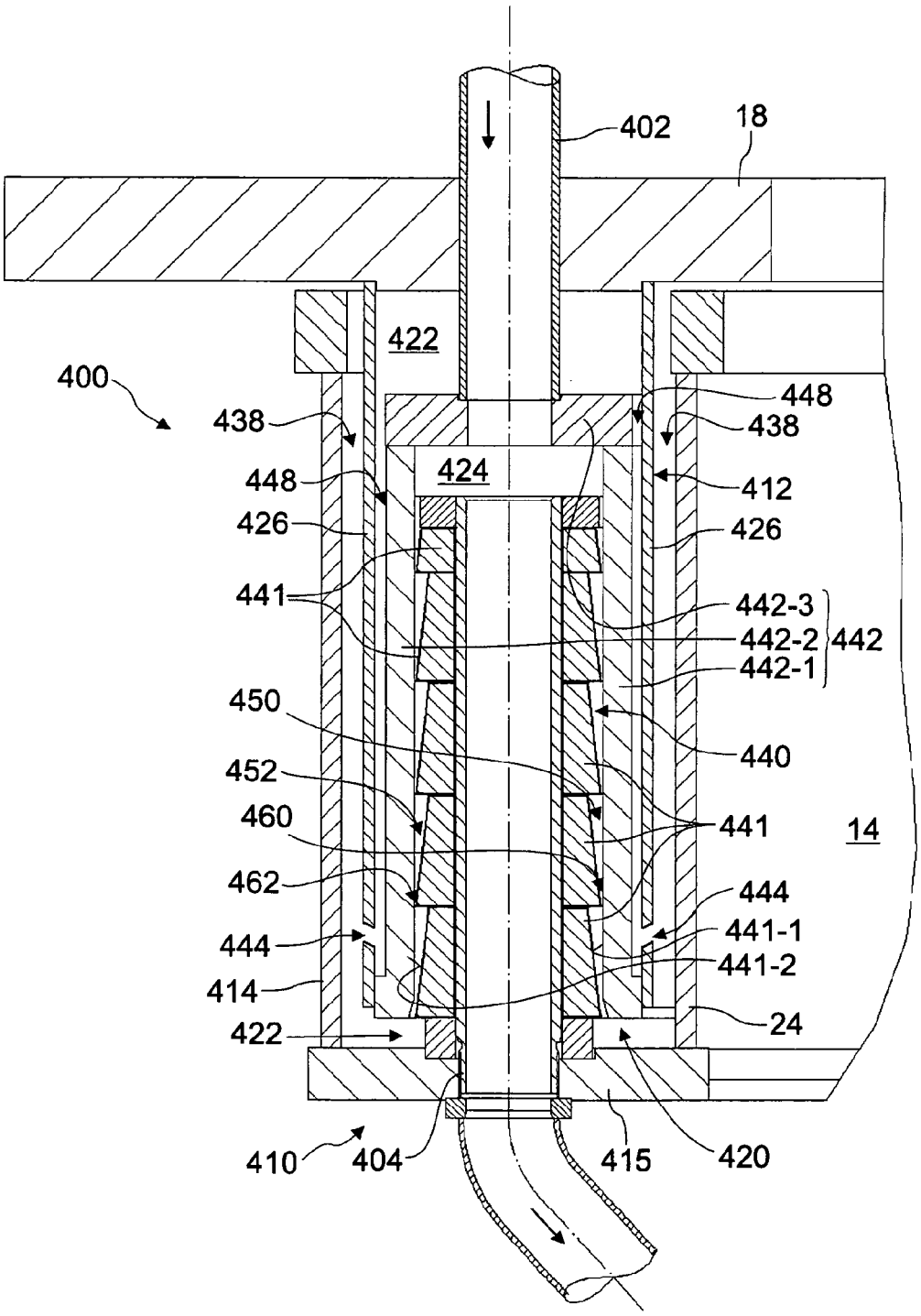
FIG. 12 is a vertical cross-sectional view of an annular swivel joint according to a fourth embodiment, which corresponds to a rotational position with coinciding lines B-B and D-D in FIGS. 5A-B.

Referring now to FIG. 12, a most preferred fourth embodiment of a swivel joint 400 will be described. The swivel joint 400 of FIG. 12, whereas it provides the same benefits as the embodiment of FIGS. 10-11, is more cost-efficient in manufacture and considered more reliable.

As will be appreciated, the rotational position illustrated in FIG. 12 corresponds to that illustrated in FIG. 10, i.e. a position where the section lines A-A and C-C of FIGS. 5A-B would coincide. Accordingly, in FIG. 12, a stationary forward connection 402 and a rotary forward connection 404 are shown in axially aligned position. The rotary part 410 also comprises an annular U-shaped trough 414 into which an annular U-shaped hood 426 of the fixed part 412 similarly protrudes downwards. Between the sidewalls of the hood 426 and of the trough 414 there are similar but longer respective narrow gaps 438 that permit venting and unimpeded rotation. Venting is favored by downwardly slanting apertures 444, through which an upper portion of the external cavity 422 communicates with a lower portion thereof. The apertures 444 are provided in the lowermost region of the sidewalls of the hood 426 and define the minimum operational water level. Even though not shown in FIG. 12, it will be understood, that the stationary and rotary return connections are provided similarly as in FIG. 11, i.e. in the bottom plate 415 of the trough 414 and in the top cover of the stationary housing 18 respectively. Accordingly, as illustrated in FIG. 12, the forward path passes through the internal cavity 424, whereas the return path (not shown) passes through the external cavity 422. As in the previous embodiments, the rotary part 410 and the stationary part 412 have a generally mirror-symmetric configuration.

As will be noted when compared to FIGS. 10-11, the embodiment of FIG. 12 mainly differs in terms of the structure of the partition structure 420 and, in particular, the configuration of its rotary and stationary partition members 440, 442 and, consequently, of the first and second flow restrictors 460, 462 there between.

As seen in FIG. 12, the stationary partition member 442 comprises a hood-shaped ring assembly of inverted U-shaped cross-section that is arranged inside the hood 426. The hood-shaped ring assembly has a radially inner side 442-1, a radially outer side 442-2 and an upper plate 442-3 and can be build in simple manner, e.g. as a welded steel plate assembly. Similar to FIGS. 10-11, vertical channels 448 are provided between the sidewalls of the hood 426 and the inner and outer sides 442-1, 442-2 of the stationary partition member 442 in order to connect the upper and lower portions of the external cavity 422. Accordingly, the channels 448 form part of the external cavity 422 so that the external cavity 422 surrounds the internal cavity 424. In the embodiment of FIG. 12, the length of the channels 448 is increased however to increase the filling level.

The rotary partition 440 on the other hand comprises a plurality of vertically stacked Teflon rings 441 that protrude into the ring assembly of the stationary partition member 442. A single ring of increased height is also possible, whereas a certain minimum height is desired in order to achieve sufficient flow restriction (pressure drop). In the embodiment of FIG. 12, the Teflon rings 441 have a truncated wedge shaped cross-section that widens downwards, i.e. the rings have a radially inner face 441-1 and a radially outer face 441-2 that are oblique. Alternatively or in combination, the faces of the Teflon rings 441 can be corrugated. Each face 441-1, 441-2 is arranged with a small radial clearance, in the order of several tenths of a millimeter wide, adjacent the corresponding adjacent side 442-1, 442-2 of the stationary ring assembly 442, i.e. with the required first and second clearances 450, 452 there between in order to permit relative rotation. As will be appreciated, by virtue of the configuration of the Teflon rings 441, turbulence is created within the leakage-permitting clearances 450, 452. Accordingly, the faces 441-1, 441-2 in cooperation with the closely adjacent inner and outer sides 442-1, 442-2 of the stationary partition member 442 respectively form first and second flow restrictors 460, 462 of the labyrinth seal type. Teflon is preferred as material for the rings 441 since it has so-to-speak "self-lubricating" properties in case of accidental contact between the rotary and stationary partition members 440, 442. The rings 441 can by made one-piece and configured fully circumferential with corresponding bores for receiving tubes of the rotary forward connections 404 as seen in FIG. 12.

As will be understood, despite an improved structure, operation of the swivel joint 400 of FIG. 12 is generally identical to that of FIGS. 10-11 as described hereinbefore.

The invention claimed is:

1. A shaft furnace charging device equipped with a cooling system, said charging device comprising a suspension rotor with a charge distributor and a stationary housing supporting said suspension rotor so that said rotor can rotate about an axis;

said cooling system comprising a stationary circuit portion, a rotary circuit portion arranged on said suspension rotor, and an annular swivel joint arranged coaxially on said axis and connecting said stationary circuit portion with said rotary circuit portion, said annular swivel joint comprising an annular fixed part mounted on said stationary housing and an annular rotary part mounted on said suspension rotor, said fixed part and said rotary part having mating configurations that allow rotation of the rotary part relative to the fixed part and including an annular trough that defines an annular volume, via which said circuit portions are in fluidal communication;

wherein said annular swivel joint comprises:

a stationary forward connection pipe for receiving cooling fluid from said stationary circuit portion; a rotary forward connection pipe for supplying cooling fluid to said rotary circuit portion; a rotary return connection pipe for receiving cooling fluid from said rotary circuit portion; and a stationary return connection pipe for returning cooling fluid to said stationary circuit portion;

a partition dividing said annular volume into an annular external cavity and an annular internal cavity so that said internal cavity is at least partially surrounded by said external cavity, so that said forward connection pipes are coupled via one of said external and internal cavities and said return connection pipes are coupled via the other of said external and internal cavities, and with leakage-permitting communication between said external and internal cavities through an annular first clearance and through an annular second clearance, which are provided to allow relative rotation between said fixed part and said rotary part; and an annular first flow restrictor provided in said first clearance and an annular second flow restrictor provided in said second clearance, said flow restrictors being configured to reduce leakage between said external and internal cavities.

2. The shaft furnace charging device according to claim 1, wherein each of said first and second flow restrictors is respectively configured as non-contact labyrinth seal.

3. The shaft furnace charging device according to claim 1, wherein said partition is a structure that comprises an annular stationary partition member supported by said stationary housing and an annular rotary partition member supported by said suspension rotor, said internal cavity and said clearances being defined between said stationary and rotary partition members.

4. The shaft furnace charging device according to claim 3, wherein, in vertical cross-section, said stationary and rotary partition members are configured generally mirror-symmetric with respect to a vertical bisecting axis.

5. The shaft furnace charging device according to claim 1, wherein said rotary part comprises said annular trough, which is mounted on or partially formed by said suspension rotor coaxially on said axis and is preferably of generally U-shaped cross-section; and said fixed part comprises an annular hood, which is mounted on said stationary housing so as to protrude at least partially into said trough and is preferably of generally inverted U-shaped cross-section, said trough and said hood being preferably configured generally mirror-symmetric with respect to a vertical bisecting axis in vertical cross-section.

6. The shaft furnace charging device according to claim 5, wherein said stationary partition comprises a hood-shaped ring assembly, preferably of generally inverted U-shaped cross-section, that is arranged inside said hood of said stationary part and has a radially inner side and a radially outer side; and said rotary partition comprises at least one Teflon ring arranged to protrude into said ring assembly, said Teflon ring having a radially inner face and a radially outer face that cooperate with said radially inner side and said radially outer side of said ring assembly so as to provide said first and second clearance there between respectively and so as to form said first and second flow restrictors in said clearances respectively.

7. The shaft furnace charging device according to claim 6, wherein said rotary partition comprises a plurality of stacked Teflon rings, each having a cross-section of a truncated wedge shape and/or corrugated inner and outer faces so as to form said first and second flow restrictors in the manner of a non-contact labyrinth seal.

8. The shaft furnace charging device according to claim 5, wherein said hood and said trough each have annular inner and outer sidewalls, said sidewalls of said hood being separated from said sidewalls of said trough by narrow substantially vertical gaps which communicate freely through said external cavity.

9. The shaft furnace charging device according to claim 8, wherein said vertical gaps communicate with said external cavity via transverse apertures provided in said sidewalls of said hood or in between said annular hood and said stationary partition member so as to allow venting through said substantially vertical gaps.

10. The shaft furnace charging device according to claim 3, wherein:

said stationary partition member comprises an upper plate, at which one of said stationary forward connection pipe and said stationary return connection pipe is provided, said annular hood comprising a top plate, at which the other of said stationary forward connection pipe and said stationary return connection pipe is provided; and said rotary partition member comprises a lower plate, at which one of said rotary forward connection pipe and said rotary return connection pipe is provided, said annular trough comprising a bottom plate, at which the other of said rotary forward connection pipe and said rotary return connection pipe is provided;

wherein said external cavity preferably has an upper portion located between said upper plate and said top plate and a lower portion located between said lower plate and said bottom plate.

11. The shaft furnace charging device according to claim 1, wherein said external cavity comprises an upper portion arranged above said internal cavity and a lower portion arranged below said internal cavity so that said external cavity substantially surrounds said internal cavity.

12. The shaft furnace charging device according to claim 1, wherein said fixed part comprises a coolant level detection device, said level detection device being connected to control a replenishing valve connected to said stationary circuit portion; and said fixed part preferably comprises a venting device for venting gas from said external cavity.

13. The shaft furnace charging device according to claim 1, wherein said annular first clearance and said annular second clearance are generally mirror-symmetric with respect to a vertical axis and said annular first flow restrictor is a non-contact labyrinth seal arranged radially outward and said annular second flow restrictor is a non-contact labyrinth seal arranged radially inward.

* * * * *